US007934972B1

(12) United States Patent
Barber et al.

(10) Patent No.: US 7,934,972 B1
(45) Date of Patent: May 3, 2011

(54) VERTICAL FLYING OBJECT

(76) Inventors: Wayne L. Barber, New Richland, MN (US); Gene R. Barber, Waseca, MN (US)

( * ) Notice: Subject to any disclaimer, the term of this patent is extended or adjusted under 35 U.S.C. 154(b) by 877 days.

(21) Appl. No.: 11/690,239

(22) Filed: Mar. 23, 2007

Related U.S. Application Data

(60) Provisional application No. 60/767,418, filed on Mar. 27, 2006.

(51) Int. Cl.
*A63H 33/40* (2006.01)

(52) U.S. Cl. ..... 446/176; 446/217

(58) Field of Classification Search ..... 446/178, 446/179, 241, 247, 255, 486, 490, 176, 217, 446/314; 40/415, 417, 477
See application file for complete search history.

(56) References Cited

U.S. PATENT DOCUMENTS

| | | | | | |
|---|---|---|---|---|---|
| 1,304,139 | A | * | 5/1919 | Young | 446/228 |
| 1,441,261 | A | | 1/1923 | Ackman | |
| 1,524,313 | A | | 1/1925 | Rumohr | |
| 1,531,566 | A | | 3/1925 | Moiseve et al. | |
| 1,620,991 | A | * | 3/1927 | Brown | 244/155 R |
| 1,666,806 | A | | 4/1928 | Wright | |
| 1,974,737 | A | * | 9/1934 | Casteig | 40/440 |
| 2,471,199 | A | | 5/1949 | Coyne et al. | |
| 2,535,165 | A | | 12/1950 | Shoemaker | |
| 2,637,928 | A | * | 5/1953 | Tufts | 40/413 |
| 2,785,871 | A | | 3/1957 | Flint et al. | |
| 2,833,497 | A | | 5/1958 | Young | |
| 2,946,544 | A | | 7/1960 | Kinney | |
| 3,006,586 | A | * | 10/1961 | Strelakos, Jr. | 244/155 R |
| 3,091,420 | A | | 5/1963 | Deguin | |
| 3,105,663 | A | | 10/1963 | Biddick | |
| 3,227,404 | A | | 1/1966 | Scharge | |
| 3,590,519 | A | * | 7/1971 | Spilhaus | 446/315 |
| 3,596,857 | A | * | 8/1971 | Battles | 244/155 A |
| 3,687,403 | A | | 8/1972 | Guinn | |
| 3,752,424 | A | | 8/1973 | Battles | |
| 3,848,835 | A | | 11/1974 | Browning et al. | |
| 3,960,347 | A | | 6/1976 | Stritzke | |
| 3,968,948 | A | | 7/1976 | Schmidt | |
| 4,042,195 | A | | 8/1977 | Howard | |
| 4,114,308 | A | * | 9/1978 | Grieder | 446/199 |
| 4,180,362 | A | | 12/1979 | Stair | |
| 4,385,740 | A | | 5/1983 | Smith | |
| 4,425,388 | A | * | 1/1984 | Oppenheimer, Jr. | 428/16 |
| 4,732,352 | A | | 3/1988 | The | |
| 4,850,798 | A | * | 7/1989 | Bailey | 416/11 |
| 4,854,214 | A | * | 8/1989 | Lowe | 84/404 |
| 5,027,539 | A | * | 7/1991 | Orsini | 40/415 |
| 5,182,146 | A | * | 1/1993 | O'Hara | 428/31 |
| 5,718,962 | A | * | 2/1998 | Walling | 428/99 |
| 5,743,781 | A | * | 4/1998 | Lee | 446/315 |
| D410,214 | S | * | 5/1999 | Nielsen | D11/131 |
| 6,074,267 | A | * | 6/2000 | Plow | 446/176 |

(Continued)

*Primary Examiner* — Alvin A Hunter
*Assistant Examiner* — Alyssa M Hylinski
(74) *Attorney, Agent, or Firm* — Moore & Hansen, PLLP

(57) ABSTRACT

Flying devices which can ride up and down along a vertical elongate guide member in response to air flow over an airfoil portion of the device. Strings and wires can be used for elongate guide members in some embodiments. Some embodiment flying devices have an adjustable angle of attack. Some devices include an angle of attack lock to lock in a negative angle of attack at a top stop and/or lock in a positive angle of attack at a bottom stop, and a lock, release to release the lock at the opposite travel extreme. Kits having hardware for securing the elongate guide members to buildings are also provided.

35 Claims, 14 Drawing Sheets

U.S. PATENT DOCUMENTS 6,278,408 B1 * 8/2001 Segovia, Jr. ..... 343/715
6,283,816 B1 9/2001 Pascual
6,598,556 B1 * 7/2003 Peters ..... 116/50
7,093,385 B2 * 8/2006 Engler ..... 40/591
2003/0047059 A1 * 3/2003 Brown, Jr. ..... 84/402
2006/0083869 A1 * 4/2006 Laudick ..... 428/7

* cited by examiner 266
260
262
261
WIND
268
264
263

VERTICAL FLYING OBJECT

RELATED APPLICATIONS

The present application is a non-provisional of U.S. Provisional Patent Application No. 60/767,418, filed Mar. 27, 2006, titled WIND POWERED VERTICALLY FLYING OBJECT, hereby incorporated by reference.

TECHNICAL FIELD

The present invention is related generally to flying ornamental objects. More specifically, the present invention is related to flying objects that can ride up and down on a vertical guide in the presence of a sufficiently strong air current.

BACKGROUND

People have always been fascinated with flying objects, including birds and other flying objects. Such fascination has been captured in early flying machine designs, airplanes, kites, hang gliders, model planes, model birds, remote control planes, wind up flying bird toys, and realistic looking fabric, bird-like objects which flutter in the wind. Artificial birds, flying machines and flying toys have found use as sport and amusement objects, hunting decoys, and scarecrows.

What would be desirable are improved bird and plane replicas or flying objects that can be made to fly and do tricks in a controlled area, with or without assistance, using moving air, either natural wind or artificially created breeze.

SUMMARY

Some embodiments of the present invention provide a flying object kit including an elongate guide member and a body having a front portion, a rear portion, an airfoil portion, and a channel having a substantially vertical region formed through the body and sized to slidably receive the elongate guide member. The kit may also have an upper stop adapted to couple to the elongate guide member which limits upward travel of the body along the elongate guide member and a lower stop adapted to couple to the elongate guide member which limits downward travel of the body along the elongate guide member.

Some embodiment kits include a weight for securing to the elongate guide member to apply tension to the elongate guide member, where the weight may include a bird feeder, and/or be made of a clear material such glass or plastic. The clear material may include a cavity for receiving a material such as a liquid. Some weights include batteries and/or electronics. The weight may form the lower stop in some embodiments.

Some embodiment kits also include means for securing the elongate guide member to a stationary object, for example rigid brackets, resilient brackets, hooks, loops, rings, and the like.

Some kits according to the present invention include means for adjusting the angle of attack of the air foil by adjusting the disposition of the elongate guide member in the channel. Some embodiments also include means for decreasing the airfoil angle of attack responsive to the object reaching the upper stop and means for increasing the airfoil angle of attack responsive to the object reaching the lower stop. Some elongate guide member embodiments are a string.

In some embodiments, a flying object kit is provided which includes an elongate guide member and a body having a front portion, a rear portion, a wing portion, and a channel having a substantially vertical region formed through the body and sized to slidably receive the elongate guide member. The kit may also include a lower support securing the elongate guide member and a blower for blowing air toward the wing portion to urge the body to rise upward along the elongate guide member. In some embodiments, the elongate guide member has strength in compression and the elongate guide member is freestanding, being unsupported in the elongate guide member upper region. Some blowers are adapted to be powered by a computer USB port. The output of the blower changes with time in some embodiments, such that the body rises and falls along the elongate guide member responsive to the varying blower output.

Some embodiments provide a flying object kit including a body having a front portion, a rear portion, a wing portion, and a channel having a substantially vertical region formed through the body and sized to slidably receive an elongate guide member, wherein the wing portion enables the body to rise upward along the elongate guide member when subjected to air flow. The kit may also include an angle of attack selector coupled to the body which allows the angle of attack of the wing to be fixed in more than one angle. The kit may also include the elongate guide member, in which the elongate guide member has strength in tension and essentially no strength in compression, for example, a string or wire. Some kit embodiments may include a lower travel limiter and an upper travel limiter which limit travel of the body along the elongate guide member.

In some embodiments, the channel can receive the elongate guide member in a first position in which the wing has a positive angle of attack providing lift, in a second position in which the wing has a more negative angle of attack than the first position, and in various positions in between the first and second positions. The channel may include an upper portion and a lower portion, in which the lower portion has a longer longitudinal extent than the upper portion, such that the angle of attack can be varied by varying the longitudinal position of the elongate guide member within the channel lower portion. In some embodiment kits, channel includes an upper portion and a lower portion, in which the upper portion has a longer longitudinal extent than the lower portion, such that the angle of attack can be varied by varying the longitudinal position of the elongate guide member within the channel upper portion.

The flying object may include a lock mechanism to lock the elongate guide member to impart a negative angle of attack to the flying object. Some lock mechanisms unlock the angle of attack responsive to the flying object having downward travel along the elongate guide member stopped or stop. Some flying objects also include an elastic member coupled to the body and configured for bearing against the elongate guide member to provide spring action to store energy from downward angle of attack airfoil movement, and to urge the airfoil angle of attack further positive when the angle of attack does go towards negative. The flying object may include a spring configured and shaped to be disposed between the body and the elongate guide member which stores energy to urge the airfoil angle of attack further positive.

Some embodiments of the invention provide a method for making a vertically flying object (VFO) fly, the method including slidably disposing the VFO over an elongate guide member, the VFO having a body and at least one wing portion coupled to the body. The body may have a guide channel therethrough for receiving the elongate guide member therethrough, the VFO having a user adjustable angle of attack, in which the adjustable angle of attack is adjustable between the body and the elongate guide member. The method can also include establishing an upper travel limit on the elongate guide member and a lower travel limit on the guide member, and orienting the elongate guide member in at least a somewhat vertical position. The method may further include allowing the VFO to rise and fall along the elongate guide member in response to the wind, in some embodiment methods, the VFO has a natural positive angle of attack caused by the guide channel being located forward of the VFO center of gravity, and the method includes allowing the VFO to rise to the upper travel limit and attain a more negative angle of attack than the natural angle of attack, and also includes allowing the VFO to fall to the lower travel limit and attain a more positive angle of attack than the more negative angle of attack.

Some methods can include suspending the elongate guide member from a building or other structure, and may include using a bottom weight secured to the elongate guide member to orient the elongate guide member in a substantially vertical orientation. The method may include suspending the elongate guide member and flying object between two elements secured to a structure secured to the earth, or suspending the elongate guide member and flying object between two brackets secured to a building. In some methods, the vertical flying object resembles a waterfowl decoy.

DETAILED DESCRIPTION

Figure 1:
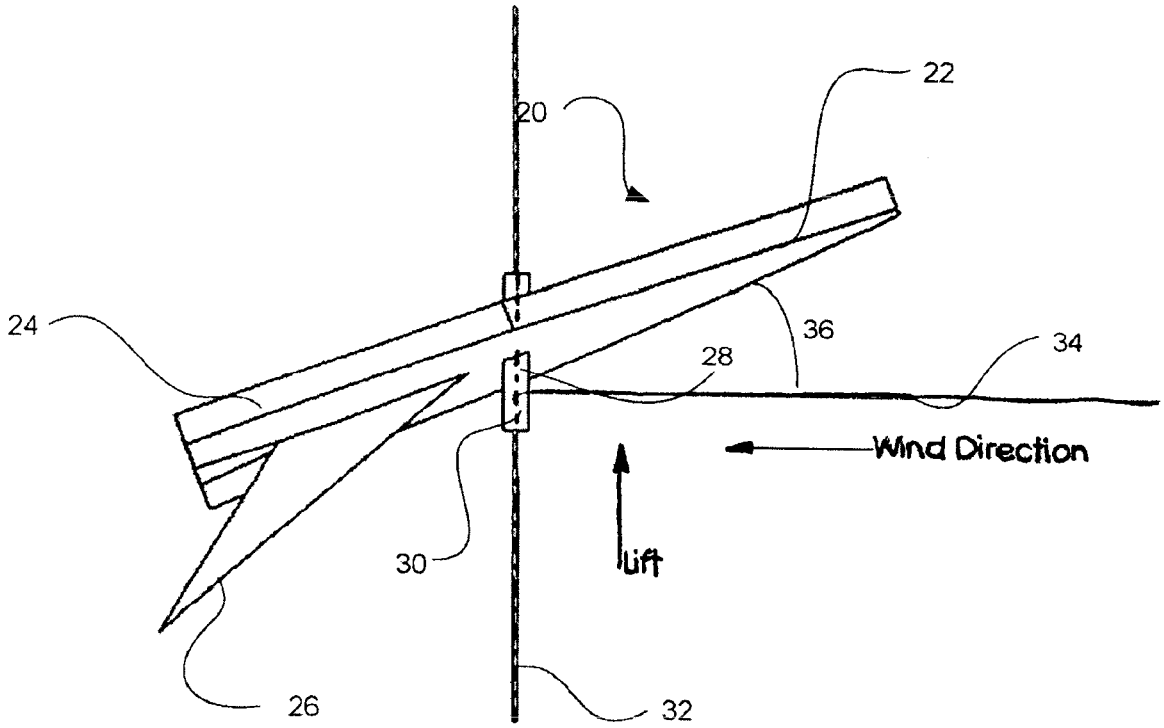
FIG. 1 is a side view of one embodiment of the invention in which the vertical flying object (VFO) has a tubular guide channel support passing through the vertical flying object body.

FIG. 1 illustrates a vertical flying object (VFO) 20 having a body 22, an airfoil portion 24, and an alignment fin 26. The alignment fin 26 can point the VFO into the wind. The view of FIG. 1 is from the bottom and side, showing the underside and a guide tube 30 having a guide channel within for receiving an elongate guide member therethrough. In various embodiments, the elongate guide member can be a string, a cable, a ribbon, a wire, a tube or a rod. The vertical axis is indicated at 32, the horizontal axis at 34, and the angle of attack at 36. Guide tube 30 can be inserted through a channel 28 formed through VFO body 22. Guide tube 30 acts as but one type of guide channel structure. This guide channel structure can be used to vary the angle of attack of the VFO. When VFO 20 is mounted on an elongate guide member, the VFO can rise and fall along the elongate guide member.

The VFO can be constructed out of lightweight materials, for example, foam, paper, plastic, balsa wood, fabric, spars, or frames. Low density foam (polystyrene) works well in some embodiments, VFOs can have a body and a wing or airfoil portion, where the wing or airfoil portion can be integral with the body or be a separate component secured to the body. The airfoil portion can provide the lift for the VFO. Some VFOs are kite or hang glider shaped VFOs, having a lightweight framework covered with fabric or plastic. Many materials, for example, molded foam, paper, fabric, metal, wood, fiberglass, carbon fiber, plastic, and the like may be used to construct some VFOs. Some VFO embodiments may have built-in, add-on, or removable parts such as spars, wings, tails, propellers, wind alignment fins or vanes, streamers, on-board electronics, computer chips, lights, payloads, and many different coverings.

The elongate member or elongate guide member can include a string, line, wire, cable, rod, pole, or tube. The guide channel for receiving the elongate guide member can be located forward of the center of gravity in many embodiments, to provide a naturally positive angle of attack caused by the rear being heavier than the front. Near the top extent of travel, where the VFO may have reached the top stop, the normally descending tail may be forced up, causing the VFO to descend or flutter, in various embodiments. The channel for receiving the elongate guide member may include a guide channel support structure in some embodiments. This guide channel support structure can provide a lock and lock release mechanism for changing the angle of attack of the VFO in some embodiments. The angle of attack can vary, but some embodiments provide a range of between about 10 degrees negative and 30 degrees positive.

Figure 2:
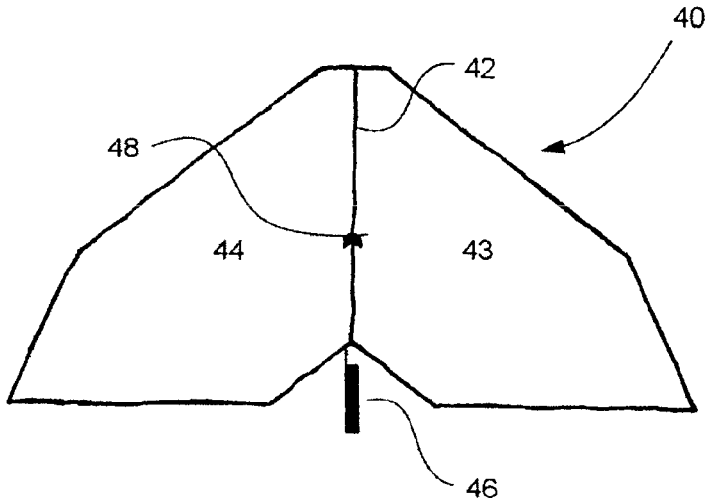
FIG. 2 is a top view of another embodiment of the invention, having a guide channel top opening.

FIG. 2 illustrates another VFO 40 having a line of symmetry 42 extending through an alignment fin or tail 46 and an alignment guide channel 48, VFO right side 43 and VFO left side 44 are disposed on either side of line of symmetry 42. In some embodiments, channel 48 has a small hole at top lengthening to a longer longitudinal slot at bottom. In other embodiments, the hole at bottom is smaller than the slot at top. In still other embodiments, the channel is smallest at the middle in a throat region located between the top and bottom.

Figure 3:
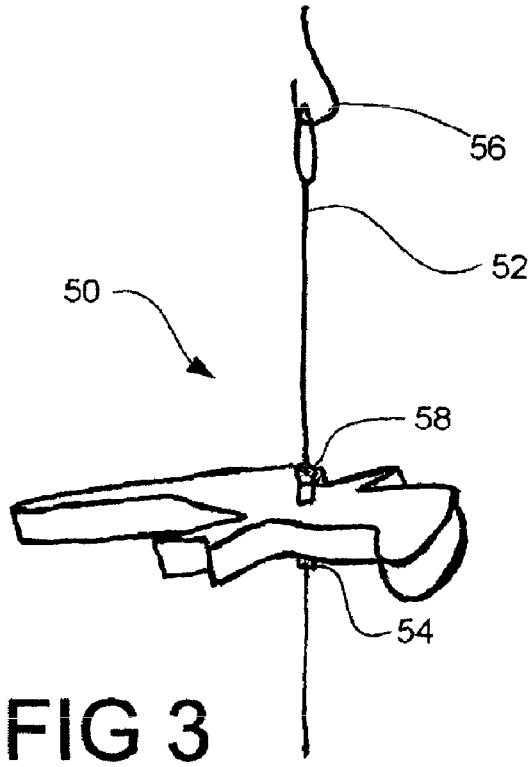
FIG. 3 is a rear, perspective view of one embodiment of the invention having a clamp style upper stop on the elongate guide member, which passes through the guide channel.

FIG. 3 illustrates another VFO 50 in the shape of a bird, VFO 50 has a guide channel tube 54 slidably receiving an elongate guide member 52 which is a string secured to an upper support element 56, which is a hook in this embodiment. An upper stop 58 is secured to elongate guide member 52 to limit the upward travel of VFO 50.

Figure 4:
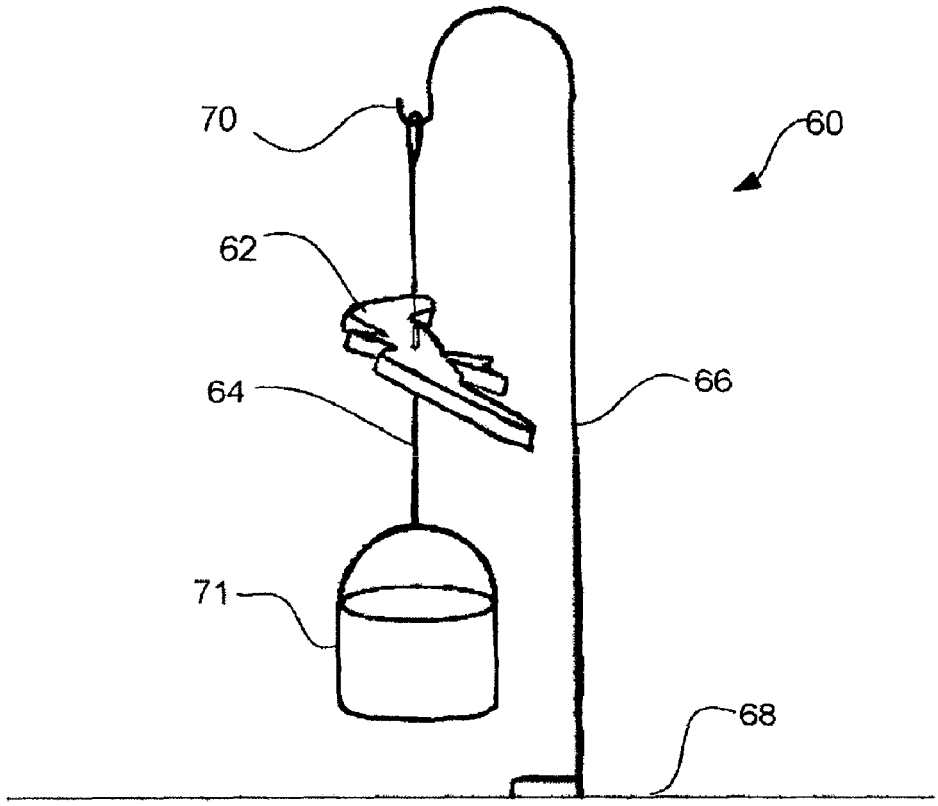
FIG. 4 is a side view of one embodiment of the invention having a translucent container securing the vertical elongate guide member at the bottom.

FIG. 4 illustrates a VFO system 60 including a VFO 62 traveling along an elongate guide member 64 which is coupled to an upper support member 70 at top and a bottom weight 71. In this embodiment, a supporting device 66 is anchored to the ground at 68. In some embodiments, the lower weight also serves as a lower stop; while in other embodiments a separate element serves as the lower stop. In this embodiment, bottom weight 71 is translucent or transparent, to reduce visibility. Some such bottom weights include a cavity which can be filled with water or other media.

Figure 5:
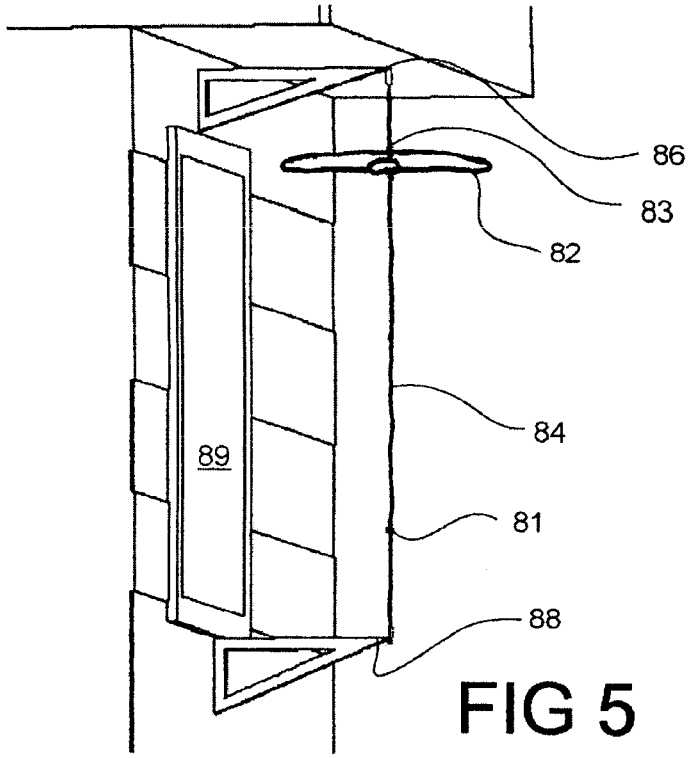
FIG. 5 is a perspective view of one embodiment of the invention mounted outside of a building window and having the vertical elongate guide member top and bottom secured to the building with brackets.

FIG. 5 illustrates another VFO system including a VFO 82 traveling along an elongate member 84 which is coupled between an upper rigid bracket 86 and a lower rigid bracket 88. Brackets 86 and 88 are secured to a building having a window 89 for viewing the VFO. An upper stop 83 and a lower stop 81 are fixed to elongate member 84 to limit the upper and lower travel of the VFO. In some embodiments, a tension spring is coupled in-line with the elongate guide member to maintain tension in the line.

Figure 6:
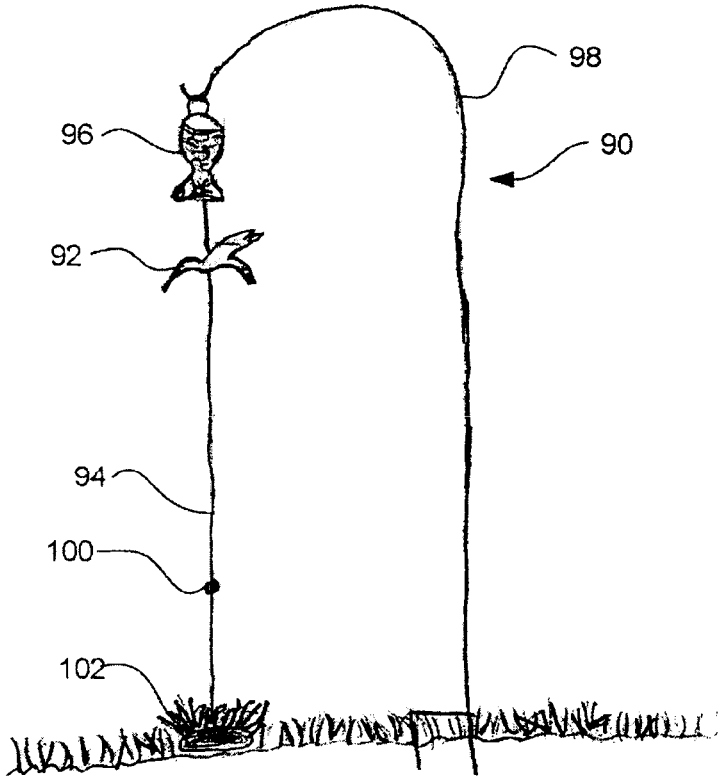
FIG. 6 is a side view of one embodiment of the invention having a bird-like flying object riding on a translucent vertical elongate guide secured at bottom by weighted artificial grass and at top by a suspended hummingbird feeder.

FIG. 6 illustrates yet another VFO system 90 in which a VFO 92 resembling a hummingbird travels up and down on an elongate guide member 94 hanging downward from a hummingbird feeder 96. Elongate guide member 94 can be a fishing line, for example, a nearly invisible four pound translucent monofilament, in some embodiments. Elongate guide member 94 includes a bottom stop 100 and a bottom weight 102, which is a weighted clump of artificial grass in this embodiment. A shepherds hook or crook 98 is driven into the ground and supports hummingbird feeder 96 in this embodiment.

Figure 7:
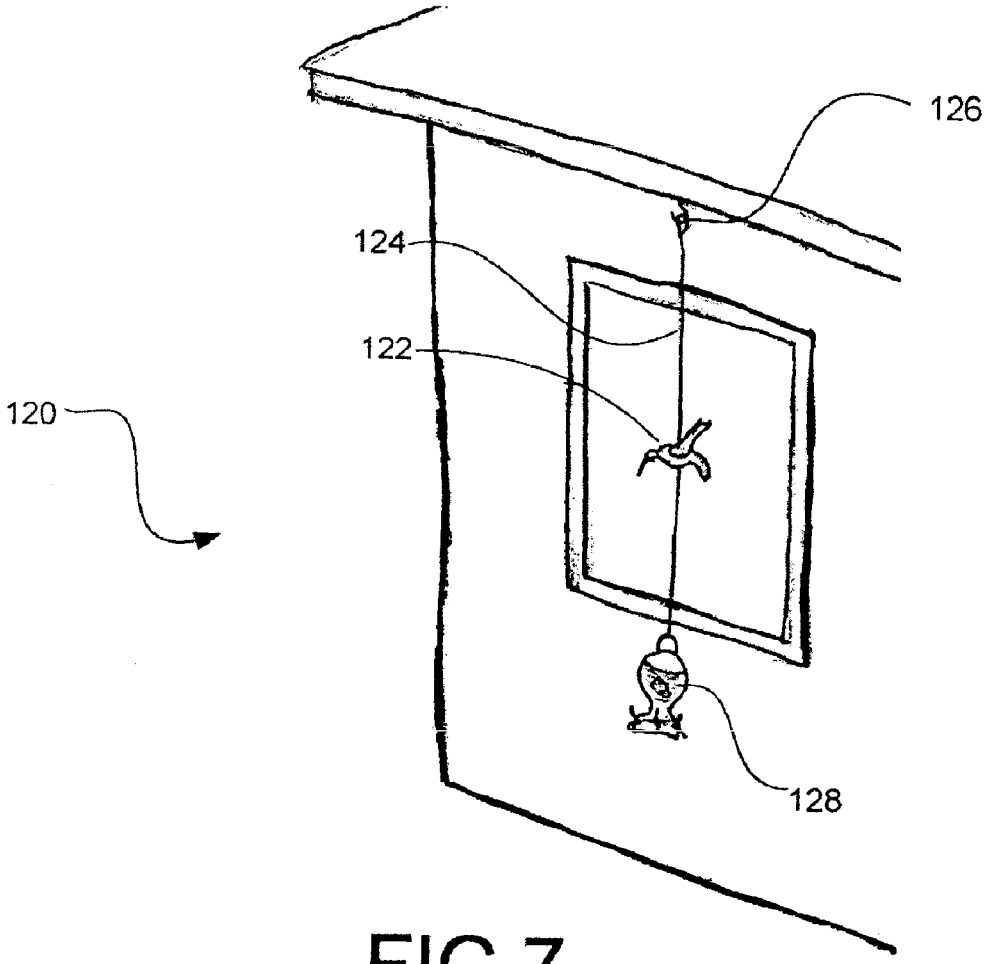
FIG. 7 is a perspective view of another embodiment of the invention having a bird-like flying object riding on a vertical elongate guide member secured at bottom by a hummingbird feeder and at top by a stationary building cave.

FIG. 7 shows another VFO system 120 having VFO 122, which is an artificial hummingbird, where the elongate member 124 is suspended from a building cave by a hook 126. A bottom weight, here a hummingbird feeder 128, maintains elongate member 124 in a substantially vertical orientation.

Figure 8:
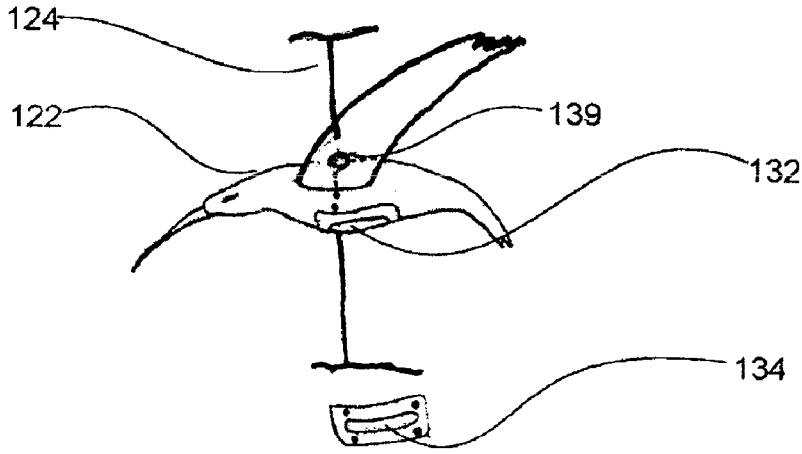
FIG. 8 is a fragmentary perspective view of the flying object of FIG. 7, in which the flying object has an adjustable angle of attack.

FIG. 8 illustrates the VFO system of FIG. 7, showing hummingbird 122 and elongate member 124. Elongate guide member 124, which can be a string, passes through a guide channel 132 passing through the hummingbird. Guide channel 132 has a longitudinally oriented long bottom slot and a smaller top opening 130, in the embodiment shown. Top opening can be formed through a bead or bushing in some embodiments. A bottom structure, here a slotted guide support 134 can be used to vary the angle of attack of the VFO. In some embodiments, the slotted guide support can be used to fix the elongate guide member in a variety of angular positions, for example, using lateral engagement teeth or a friction fit, to maintain a desired angle of attack once selected.

Figure 9:
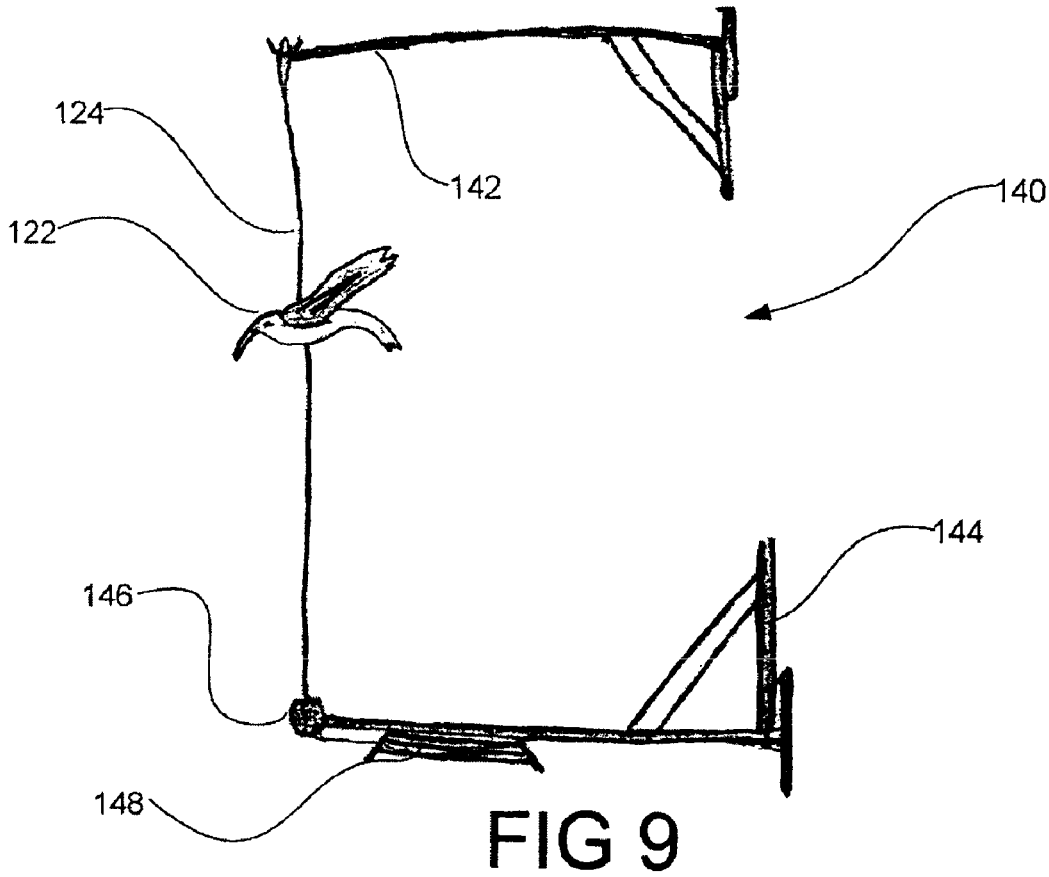
FIG. 9 is a side view of yet another embodiment of the invention having a bird-like flying object riding on a vertical elongate guide member secured at top and bottom by tension brackets secured to a stationary building.

FIG. 9 illustrates still another VFO system 140 having a top bracket 142, a bottom bracket 144, VFO 122 and elongate guide member 124. In this embodiment, a take up spool 14S stores extra elongate guide member line and a reel or pulley 145 is disposed at the end of bottom bracket 144 to provide fine tension adjustment. A tension spring can be coupled between elongate guide member 124 and top bracket 142 to maintain tension in the elongate guide member. In some embodiments, the top and bottom brackets are tension brackets which can maintain tension in the elongate member even without a spring. In such embodiments, the tension brackets can themselves include resilient arms to provide tension. In other embodiments, having rigid support brackets, another tension providing mechanism, such as spring 147, may be used.

Figure 10:
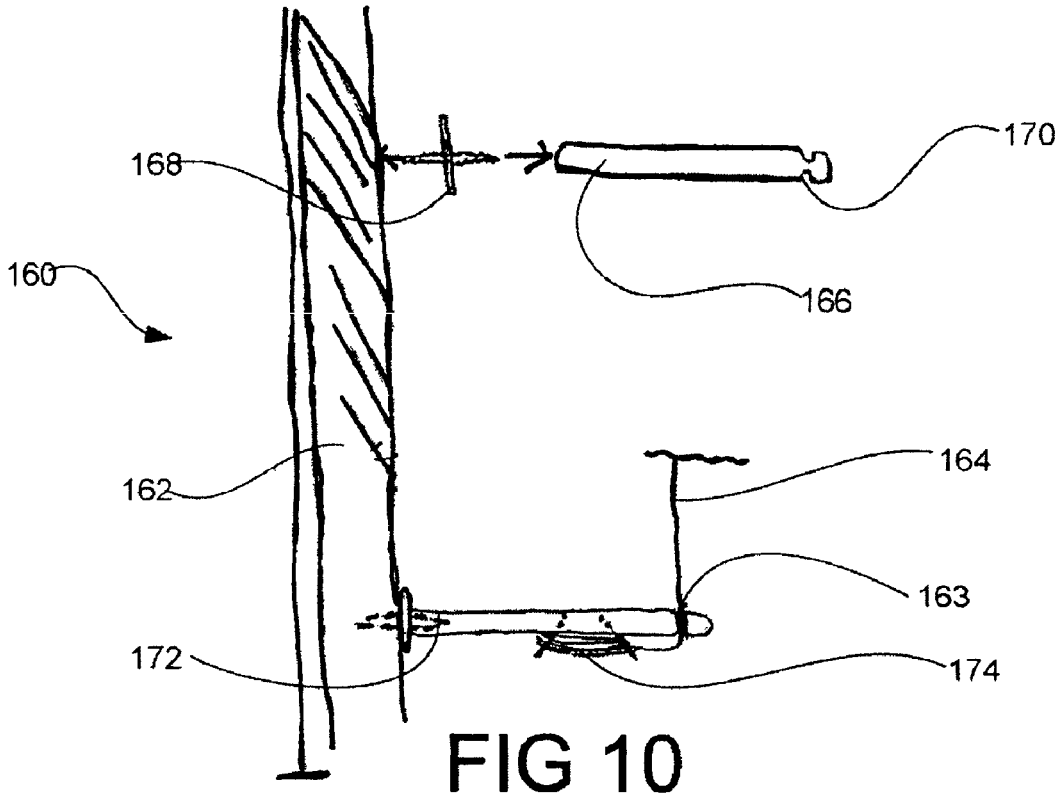
FIG. 10 is a fragmentary side view of an embodiment of the invention for guiding a vertical flying object riding on a vertical elongate guide member secured at top and bottom by brackets secured to a stationary building, in which one bracket includes a take up spool to keep a portion of the flexible elongate guide member.

FIG. 10 illustrates yet another system 160 having an upper resilient rod or tension bracket 160 having a notch 170 at one end. A wood screw 168 having a shoulder in the middle can be used to secure upper rod 166 to a pole, tree, or other structure 162. A bottom tension bracket or rod 172 is shown already secured to the pole, tree, or structure 162. A flexible elongate guide member 164 is shown wound around a bottom notch 163 for fine tension adjustment and around a take up spool 174.

Figure 11:
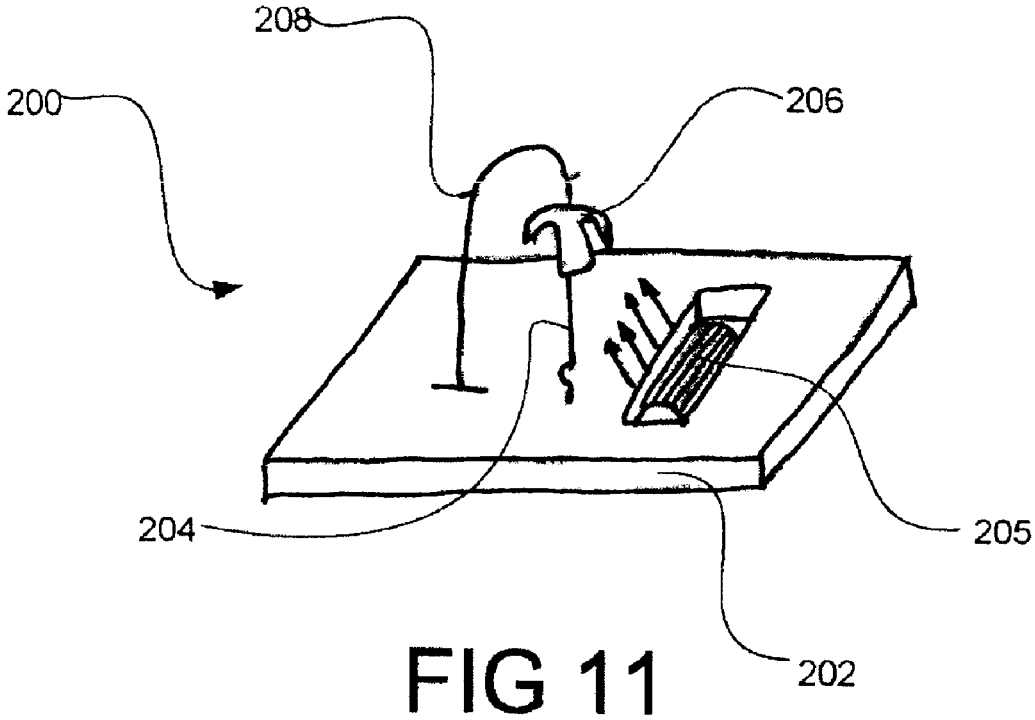
FIG. 11 is a perspective view of a VFO system having a powered blower and a platform.

FIG. 11 illustrates another system 200 having a platform 202 including a blower or fan 205 which provide an updraft. A VFO 206 is guided by an elongate guide member 204 coupled at bottom to platform 202 and at top to a support device 208 secured to platform 202. Blower 204 can be a rotary fan or squirrel cage fan, etc, depending on the embodiment. In some embodiments, the fan is an electric fan powered by the USB port of a computer, providing desktop amusement. Some embodiments of the invention obtain an artificial air current from another source, such as a forced air duct or external fan, and do not include a fan with the kit.

Figure 12:
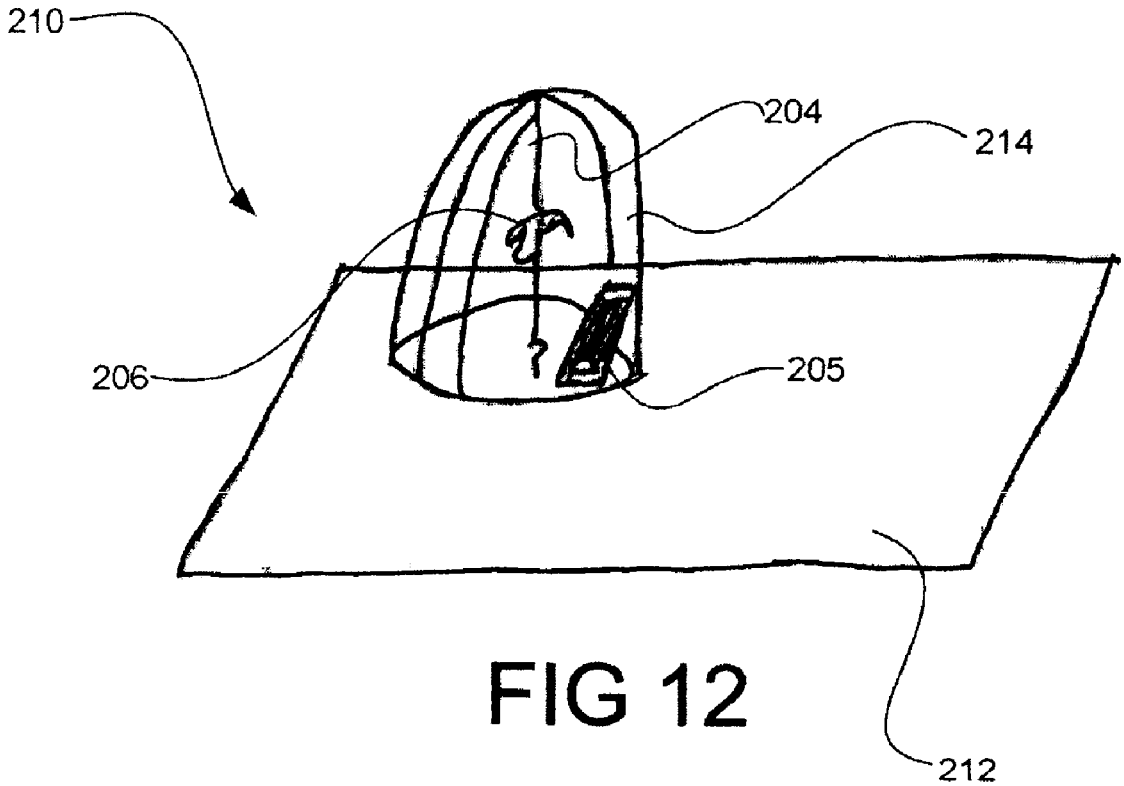
FIG. 12 is a perspective view of a bird VFO system having an artificial air current source and a bird cage.

FIG. 12 illustrates a variation on the system of FIG. 11, in a system 210. System 210 has platform 212, blower 205, VFO 206, and elongate member 204. System 210 also has a wire cage or bird cage 214. Some embodiments use the air from a building forced air heating system in place or in addition to blower 204.

Figure 13:
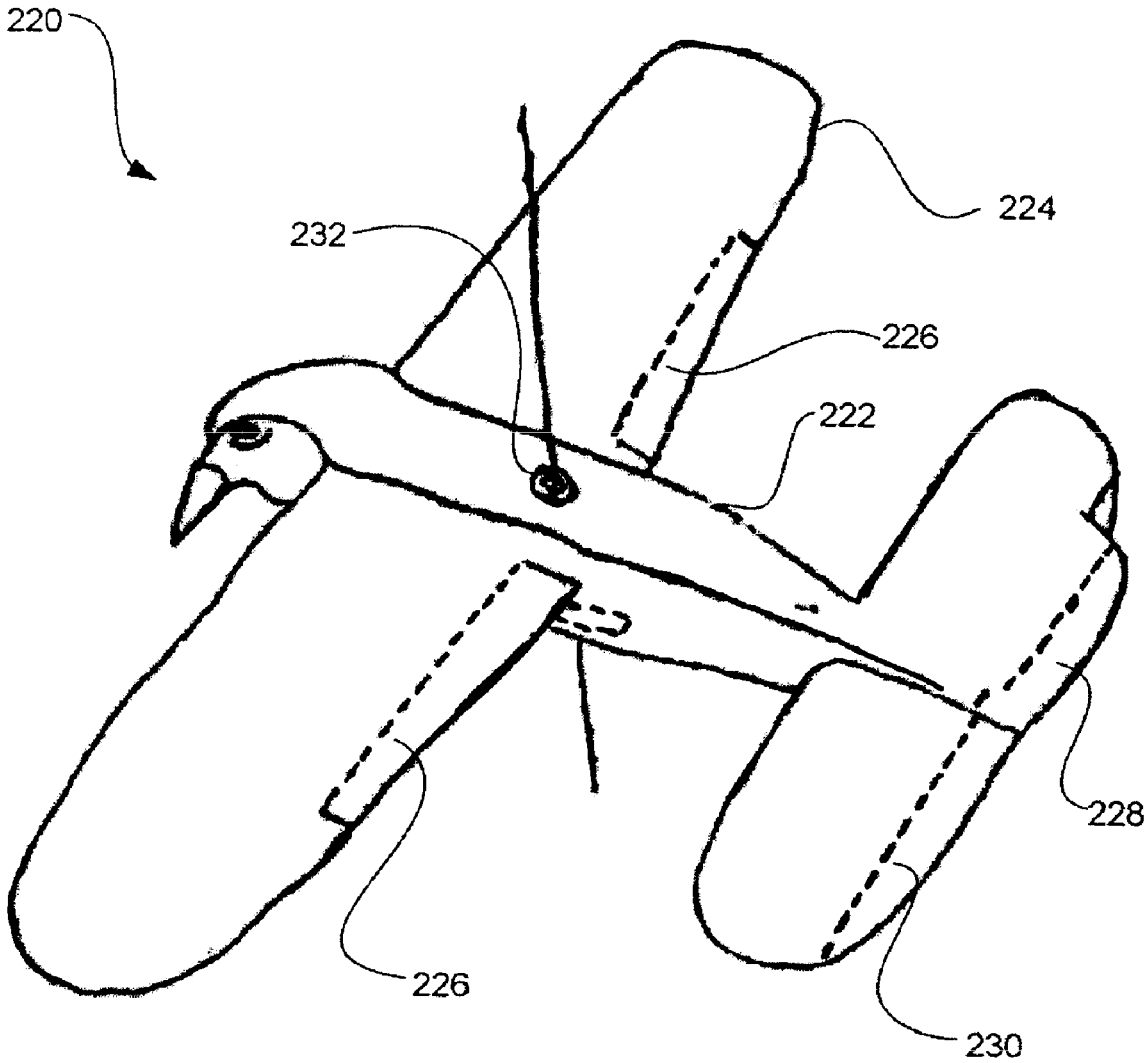
FIG. 13 is a perspective view of a bird VFO having adjustable ailerons, rudder, and elevators.

FIG. 13 illustrates another embodiment of the invention in VFO 220 having a body 222 and airfoil portion 224. Airfoil 224 includes adjustable ailerons 226, adjustable elevators 230, and an adjustable rudder 228. A guide channel enters at a small opening 232 at top and exits through a longer bottom slot 234.

Figure 14A:
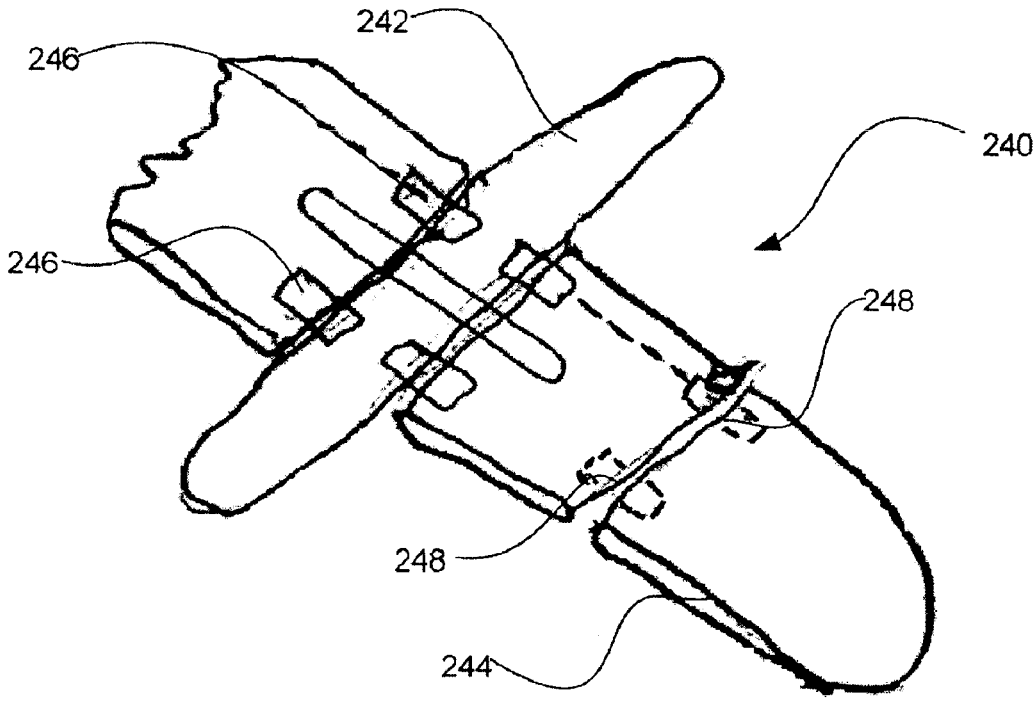
FIGS. 14A-14C are schematic, front views of a VFO having segmented, folding wings.
Figure 14B:
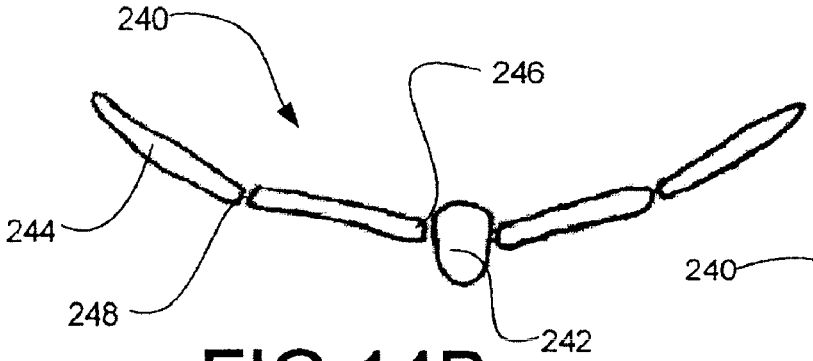
Figure 14C:
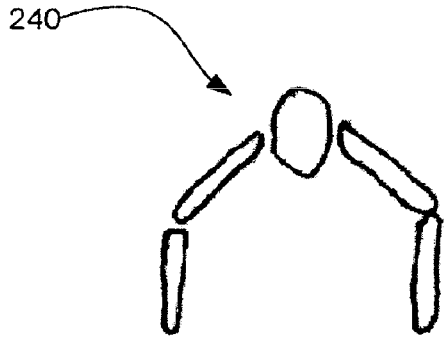

FIG. 14A illustrates another embodiment in VFO 240 having a body 242 and wings 244, where the wings are hinged at 246 and 248, allowing for more lifelike movement of the wings. FIG. 14B shows the wings extended upward while FIG. 14C shows the wings in a downward position.

Figure 15A:
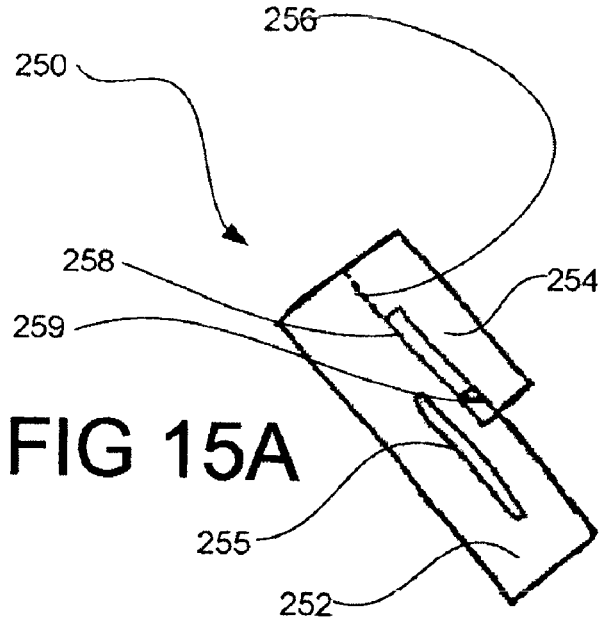
FIGS. 15A-B are perspective views of a lock and lock release mechanism being made.

FIG. 15A illustrates a structure 250 which can be used in conjunction with a long slot in the guide channel through a VFO body to receive the elongate guide member. Structure 250 in FIG. 15A is shown during manufacture, in a flat configuration, having a first flat portion 252 having a first slot 255. A bending line 256 is shown, as is a second slot 258 and a second portion 254. A lock or tooth 259 is also shown.

Figure 15B:
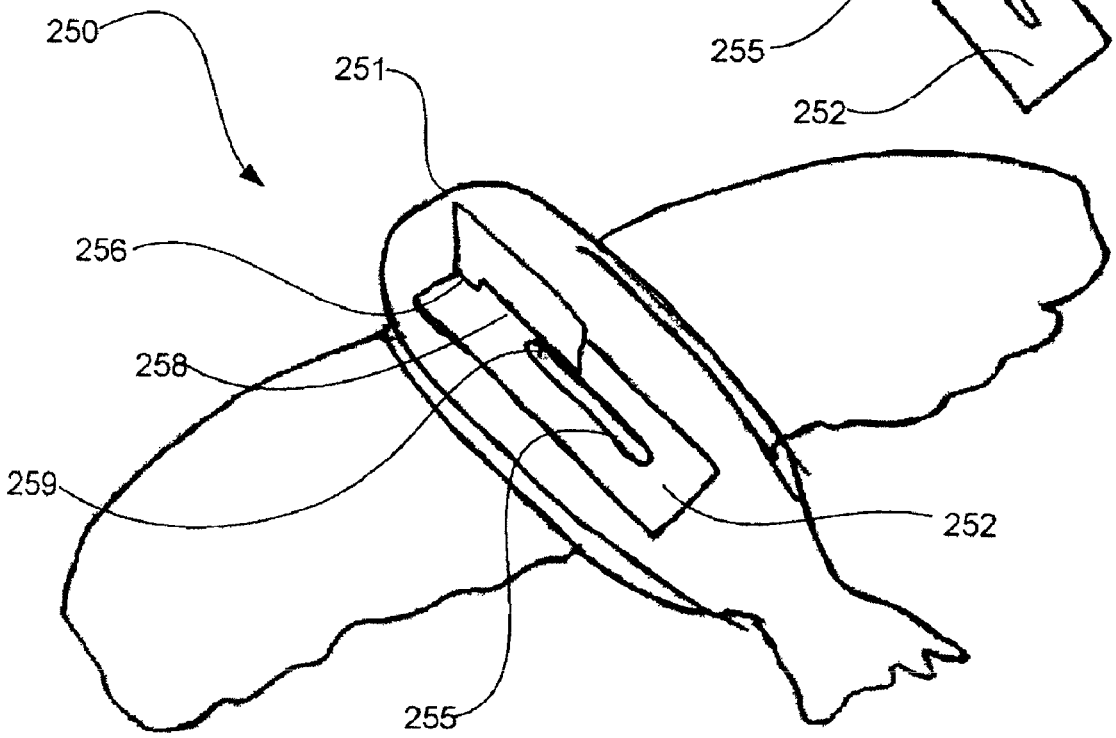

FIG. 15B shows structure 250 after being bent about line 256 and attached to the bottom of a VFO 251. Lock or tooth 259 has been bent in a horizontal position to capture the elongate guide member, such as a string or wire. The elongate guide member can be received through first slot 255, and temporarily held by lock 259. Structure 250 can be inserted within the bottom slot of the guide channel in the VFO body in some embodiments. In other embodiments, structure 250 can be inserted near the top of the VFO, or in the middle. A small member coupled to trigger the lock release may extend from the VFO in some embodiments.

Figures 16A, 16B, 16C, 16D, 16E, 16F, 16G, 16H:
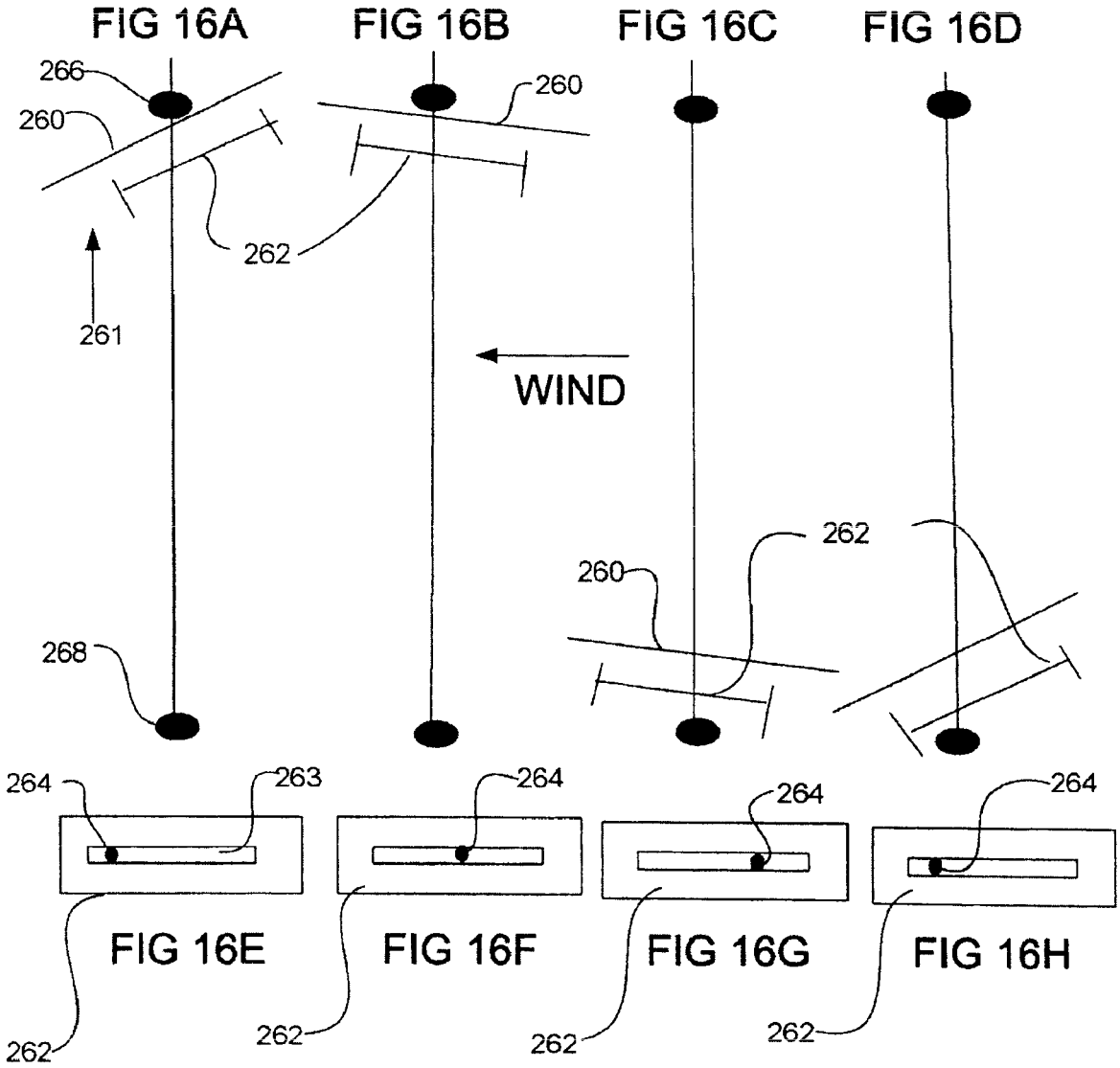
FIGS. 16A-D are schematic, side views of a VFO system, showing the body and bottom slot structure in varied vertical angle of attack positions.
FIGS. 16E-H are schematic top views of the VFO system of FIGS. 16A-D respectively, showing the bottom slot structure having the elongate guide member in the corresponding varied positions within.

FIGS. 16A-D show side schematic views of a VFO having a body 260 carrying a slotted guide structure 262 for receiving an elongate guide member 264 through the body and structure. An upper stop 266 and a lower stop 268 are also shown. In FIG. 16A, VFO body 262 has just reached upper stop 266, the body can no longer translate upward, and begins to rotate or pitch forward in response to the continued wind pressure, which acts at 261 on the VFO.

FIG. 16B shows VFO body 260 rotating or pitching forward to a negative angle of attack in response to the wind and the upper stop. The wind pressure is beginning to push the VFO downward.

FIG. 16C shows VFO body 260 after the VFO has fallen due to the negative angle of attack, and hit the bottom stop 268. FIG. 16D shows VFO body 260 with gravity pulling the VFO rear downward to impart a positive angle of attack, which will carry the VFO upward again in response to the positive angle of attack and the wind.

FIGS. 16E-16H show a top view of slot structure 262 including a slot 263 and elongate guide member 264 corresponding to FIGS. 16A-16E, respectively. In a VFO where the elongate guide member (for example, a string or wire) enters through a small opening at top and exits through an elongate slot at bottom, the position of the elongate guide member will vary with the angle of attack. When the angle of attack is positive, the elongate guide member will be located toward the rear of the slot, and when the angle of attack is negative, the elongate guide member will be located toward the front of the slot. This may be seen in FIGS. 16E-16H, where the varied position of elongate guide member 264 is intended to qualitatively illustrate one embodiment of the present invention. Note that an engagement member or lock near the slot could be used to temporarily lock the elongate guide member in a forward and/or rearward position in the slot. This would force the VFO to remain in a positive and/or negative angle of attack longer than would be the case without the lock.

In one such embodiment, a clip type lock can be added near the front of the slot, to lock in a negative angle of attack. When the VFO strikes the lower stop, this action can splay the clip to the side to free the locked elongate guide member, allowing the elongate guide member to travel rearward to attain a positive angle of attack.

Figures 17, 18:
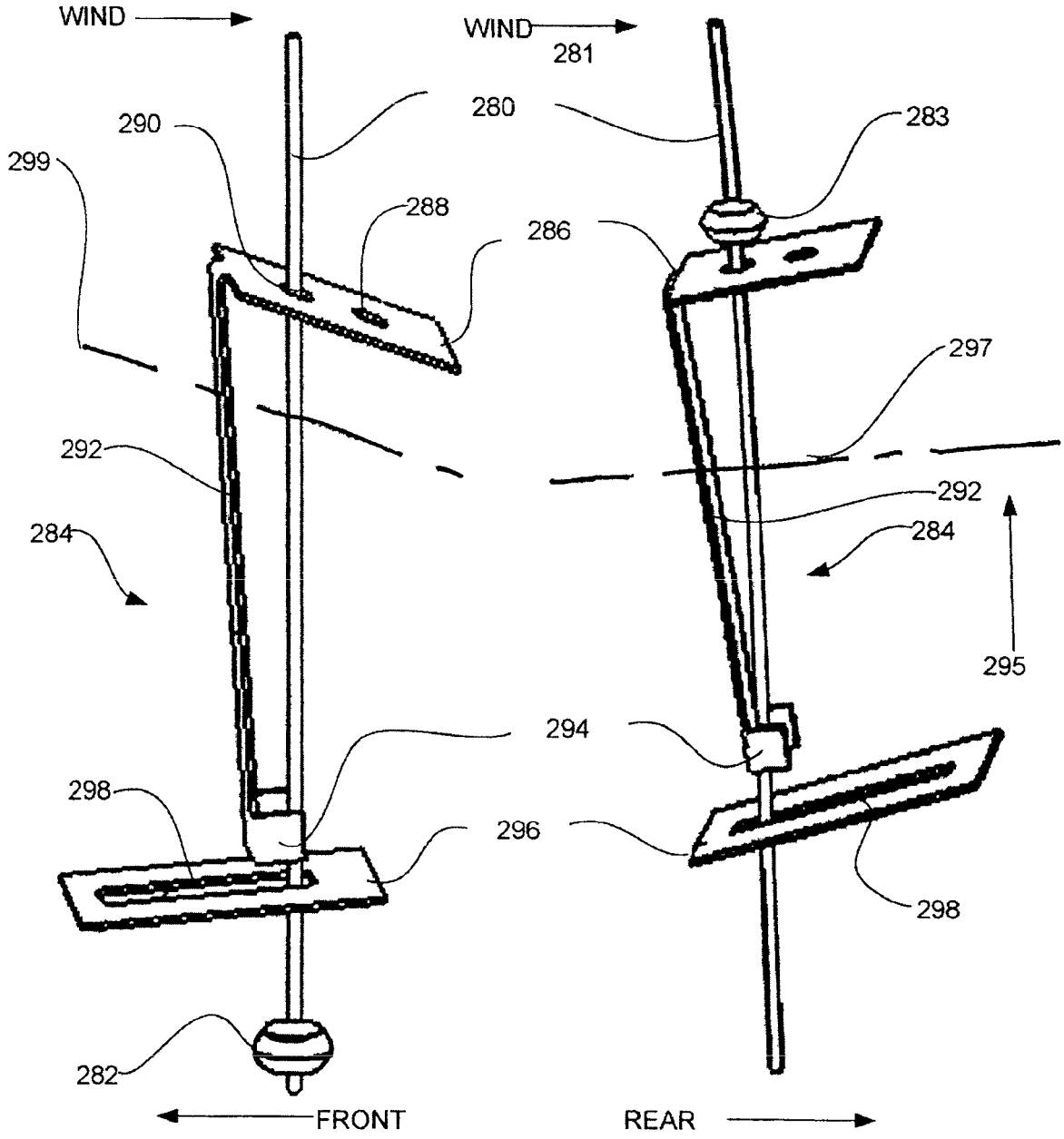
FIG. 17 is a perspective view of a pusher arm and bottom slot support disposed near the bottom of an elongate guide member shown in a positive angle of attack configuration, with the pusher arm relaxed.
FIG. 18 is a perspective view of the pusher arm and bottom slot support of FIG. 17, disposed near the top of an elongate guide member, having a more negative angle of attack than that of FIG. 17, with the pusher arm being flexed.

FIG. 17 illustrates a substantially vertical elongate guide member 280 having a bottom or lower stop 282. A guide channel structure 284 is shown, which can be inserted into an aperture in a VFO to receive elongate guide member 280. Guide channel structure 284 can be made of resilient sheet metal or plastic, in some embodiments. Guide channel structure 284 includes an upper portion 286 having a rear receiving hole 288 and a front receiving hole 290, where elongate guide member 280 has been inserted through front receiving hole 290. Some embodiments have more than two receiving holes, where the various holes can be used to vary the angle of attack of the VFO. Guide channel structure 284 further includes a pusher arm 292, which can be elastically resilient to provide a spring force, explained further below. Pusher arm 292 is shown in a relaxed, unstressed state, disposed near the rear of slot 298. A pair of side arms 294 are coupled to or built into the bottom of pusher arm 292, extending rearward on either side of elongate member 280 to trap elongate member 280. A bottom, slot guide 296 having a slot within is shown disposed beneath pusher arm 292, receiving elongate member 280 near the rear of slot 298, indicating that the angle of attack is positive. The positive angle of attack can cause the VFO to rise until the top stop is reached. This positive angle of attack is also shown at 299.

FIG. 18 again illustrates guide structure 284 of FIG. 17, this time having upper portion 286 pushing against top stop 283. The wind direction is indicated at 281. The wind pressure against the rear of the airfoil, indicated at 295 can cause the VFO to pivot or pitch downward from the previous positive angle of attack, with the angle of attack shown as horizontal at 297. This downward change in the angle of attack also causes elongate member 280 to move forward within slot 298. The downward pitch of the airfoil while the VFO is still pinned against top stop 283 can cause pusher arm 292 to flex, bowing rearward, and storing some force which may later urge the airfoil to a more positive angle of attack when the VFO is no longer pinned against the top stop. In this way, after the VFO begins to move downward, the angle of attack may be urged upward, to an angle in which the descent of the VFO is not as rapid. Thus, an angle of attack sufficiently negative to begin the descent of the VFO can be attained, followed by an angle of attack less negative or even positive, providing a gentle descent, flapping, or a fluttering motion.

Figure 19A:
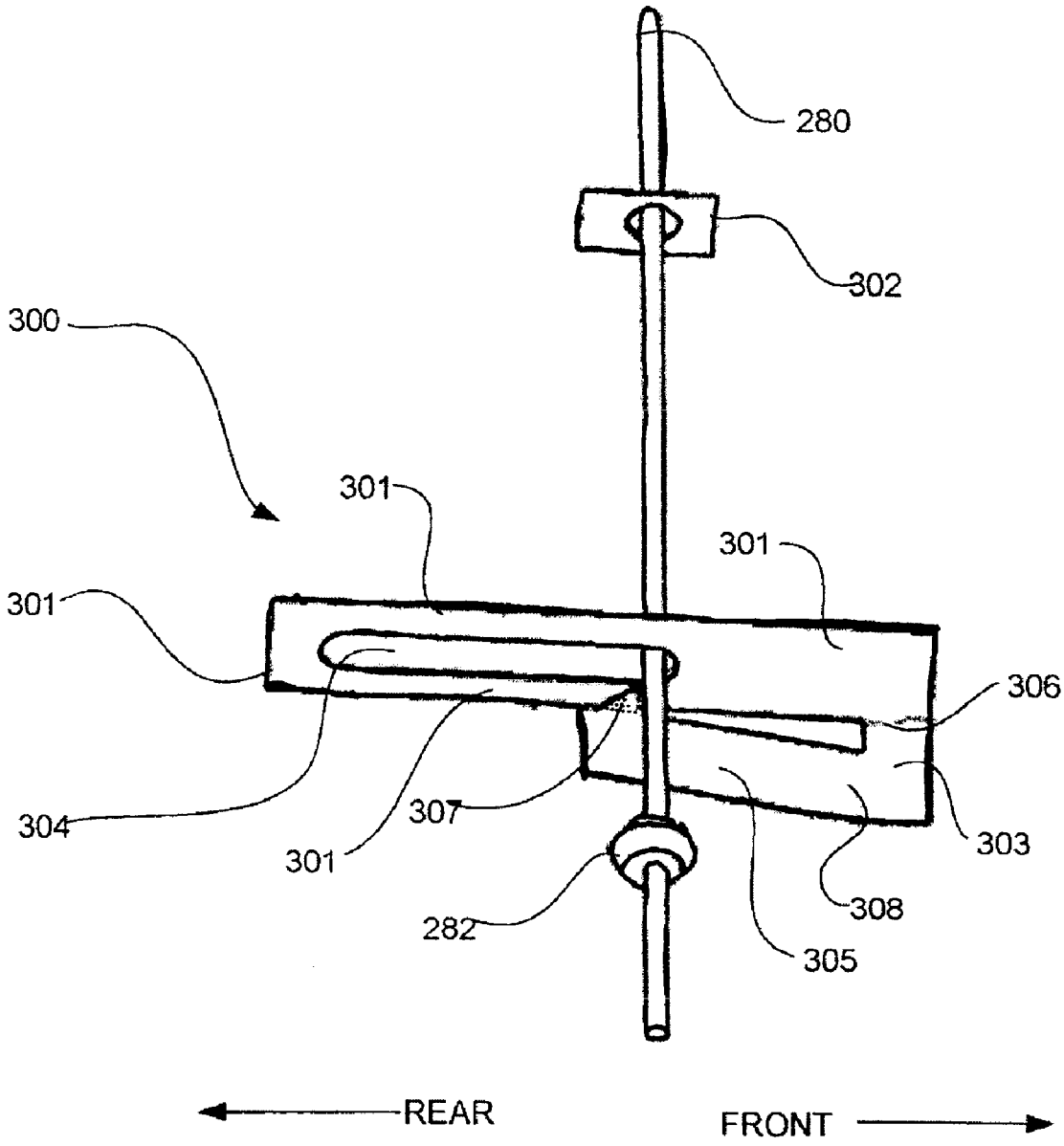
FIGS. 19A-19C are perspective views of a bottom slot support having a lock and lock release mechanism.
Figure 19B:
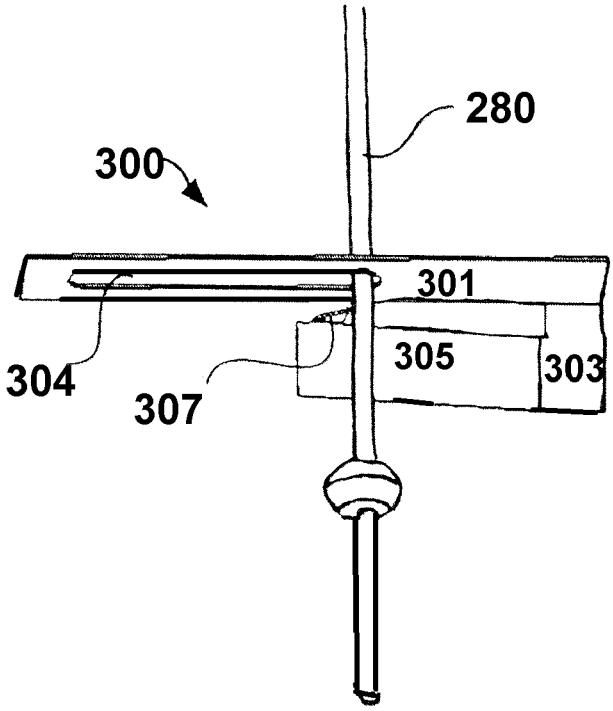
Figure 19C:
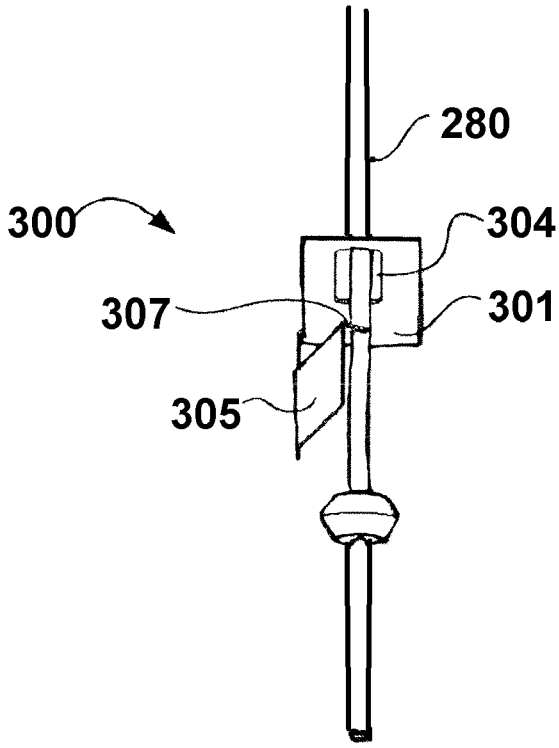

FIGS. 19A-19C illustrate an elongate guide member locking support structure 300 slidably disposed on elongate guide member 302. A top aperture guide for receiving elongate member 280 near the top of the VFO body (not shown in FIGS. 19A-19C) and bottom stop 282 are also shown. Slot support structure 300 includes a substantially planar, downward facing bottom surface, indicated at 301 in several positions for clarity. Tooth 307 may be understood to lie between the viewer and bottom surface 301 in this embodiment, not interrupting the bottom surface. A bottom slot 304 is formed in a rear portion of bottom surface 301 for receiving elongate guide member 280. With bottom surface 301 facing vertically downward, a first finger region 303 can be bent downward part way (or all of the way in some embodiments) towards vertical along bend line 306 in some embodiments. A second finger region can be bent along a second bend line 308 to bring tooth 307 across the region that is vertically below slot 304. Tooth 307 is bent substantially perpendicular to second finger region 305 in some embodiments, along a bend line.

In one example, first finger region 303 is bent 90 degrees along bend line 306, making first finger region 303 a vertical plane extending forward to backward. In this example of the invention, second finger region 305 is also a vertical plane, bent to approach the region that is vertically beneath slot 304. Finally, tooth 307 can be bent 90 degrees from second finger region 305 to form a horizontal surface to capture elongate guide member 280, locking it toward the front of slot 204 to maintain a negative angle of attack.

Many other examples of the invention are within the scope of the invention. In some of these embodiments, first finger region 303 is not bent to be vertical, but bent only part of the way toward vertical. Second finger region 305 may then be already splayed away from vertical, such that when second finger region 305 strikes a bottom stop of other object, it may be moved away from the elongate member to release the elongate guide member from the tooth or other lock mechanism being used.

When second finger region 305 strikes bottom stop 282, second finger region 305 splays away from elongate member 280, taking tooth 307 with it, thereby freeing elongate guide member 280 to travel rearward in slot 304, allowing the VFO to assume a more positive angle of attack, and begin to rise again in the presence of wind. In this way, tooth 307 acts as a lock, and second finger 305 acts as a lock release. A wide variety of bends, curves, and elements can be used to form the lock and the lock release. Numerous embodiments of this mechanism are possible and are within the scope of the present invention.

Figure 20:
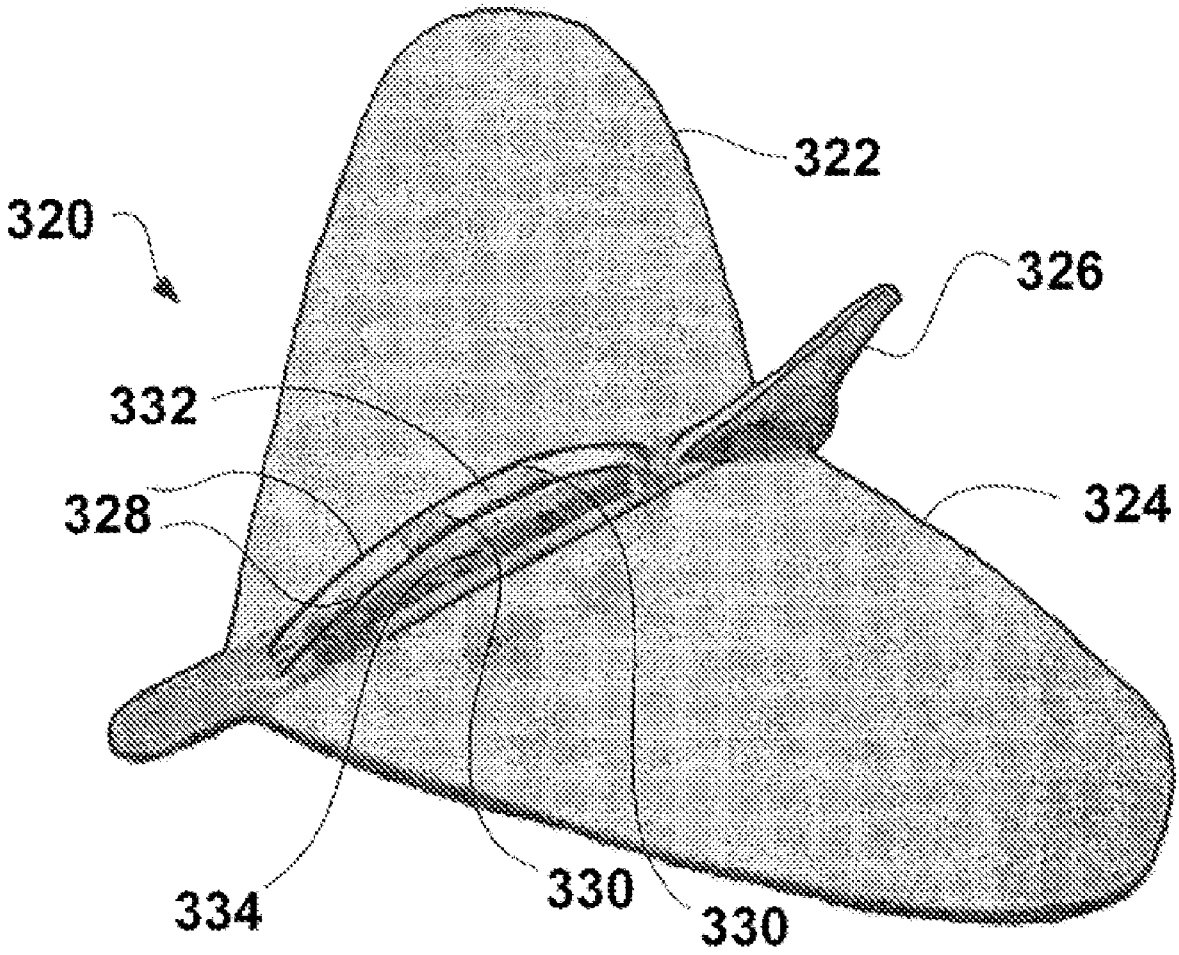
FIG. 20 is a perspective view of a VFO having several bushings above the VFO to receive the elongate guide member at various angles, to adjust the angle of attack.

FIG. 20 illustrates another VFO embodiment in VFO 320, having a right wing 322, a left wing 324, and a tail 326. A slot 334 for receiving an elongate guide member is shown, as are a pair of spaced apart rails 328, located above slot 334. Bushings 330 may be located in a variety of locations along rails 328 and then fixed in position to the rails. The angle of attack for the VFO may be determined by both adjusting the position of a bushing before fixing the bushing position, and by selecting which bushing to use to receive the elongate guide member. In one embodiment of the invention, the forward and rearward limits to travel within the rails may be fixed by using the bushings or other objects and stops. In one example, the two bushings 330 may be fixed in the positions shown in FIG. 20, and the elongate guide member inserted through space 332 located between the two bushings or stops. In this way, the angle of attack can vary from positive to negative through action at the top of the VFO. A similar structure may be used underneath the VFO, in addition to the structure at top or in place of the structure at top. The angle of attack can be forced negative at one vertical travel extreme and forced positive at the opposite vertical travel extreme, in one embodiment a small sliding weight or even fluid may be used for lock, in the angle of attack to positive and/or negative. In one such example, a BB, several BBs, metal shot, or liquid in a tube may be used to lock in the angle of attack until changed by outside forces, such as the wind action or striking a travel stop on the elongate guide member.

Various embodiments and examples have been illustrated and described to illustrate, not limit the present invention. The scope of the present invention is defined in the claims which follow.

What is claimed is:

1. A method for forming a vertically movable flying object, the method comprising the steps of:

providing a vertically flying object and elongate guide member having first and second ends;

disposing the vertical flying object over the elongate guide member, wherein the vertically flying object includes a body having a tubular and vertically oriented channel formed through the body, wherein the channel slidably receives the elongate guide member, the vertical flying object having a lifting surface with an angle of attack that is variably adjustable relative to the elongate guide member;

establishing an upper travel limit of the vertical flying object on the elongate guide member and a lower travel limit on the elongate guide member;

suspending the first end of the elongate guide member from a stationary object; and placing the elongated guide member under tension; wherein the vertical flying object can slide towards either the first or second ends of the elongate guide member when the vertical flying object is subjected to an air flow.

2. The method of claim 1, in which the vertical flying object has a natural positive angle of attack, the method further including the steps of:

allowing the vertical flying object to rise to the upper travel limit and attain a more negative angle of attack than the natural angle of attack; and causing the vertical flying object to fall towards the lower travel limit and attain a more positive angle of attack than the more negative angle of attack.

3. The method of claim 1, in which the step of suspending further includes suspending the elongate guide member from a building.

4. The method of claim 3, wherein the step of placing the elongated guide member under tension further includes securing a weight adjacent the second end of the elongate guide member.

5. The method of claim 1, wherein the step of placing the elongated guide member under tension further includes securing the second end of the elongate guide member to a structure secured to the earth.

6. The method of claim 1, wherein the step of placing the elongated guide member under tension further includes securing the first and second ends of the elongate guide member to respective brackets secured to a building.

7. The method of claim 1, in which the vertical flying object resembles a waterfowl decoy.

8. The method of claim 1, further comprising adjusting the angle of attack.

9. The method of claim 1, in which the vertical flying object has an adjustable first angle of attack limit and an adjustable second angle of attack limit, in which the first angle of attack limit corresponds to a more positive angle of attack than the second angle of attack limit, the method further comprising adjusting the first and second angle of attack limits.

10. A flying object kit comprising:

an elongate guide member having first and second ends;

a vertical flying object having a body having a front portion; a rear portion, an airfoil portion; and a tubular and vertically oriented channel formed through the body and sized to slidably receive the elongate guide member;

an upper stop adapted to couple to the elongate guide member which limits upward travel of the body along the elongate guide member; and a lower stop adapted to couple to the elongate guide member which limits downward travel of the body along the elongate guide member;

wherein the elongate guide member is configured to be suspended by the first end to a stationary object and the elongate guide member is configured to be placed under tension; wherein, when assembled, the vertical flying object can slide along the tensed elongate guide member towards either the first or second ends of the elongate guide member when the vertical flying object is subjected to an air flow.

11. The kit of claim 10, further comprising a weight removably secured to the second end of the elongate guide member, the weight serving to apply tension to the elongate guide member.

12. The kit of claim 11, in which the weight includes a bird feeder.

13. The kit of claim 11, in which the weight includes a substantially clear material.

14. The kit of claim 11, in which the weight includes batteries and/or electronics.

15. The kit of claim 10, further comprising a blower for directing a flow of air toward the airfoil portion so as to enable the body to move vertically along the elongate guide member.

16. The kit of claim 13, in which the substantially clear material includes a cavity adapted to contain a liquid or other media.

17. The kit of claim 11, in which the weight provides the lower stop.

18. The kit of claim 10, further comprising means for securing the elongate guide member to the stationary object.

19. The kit of claim 10, further comprising means for adjusting the angle of attack of the air foil by adjusting the disposition of the elongate guide member in the channel.

20. The kit of claim 10, further comprising means for decreasing the airfoil angle of attack responsive to the object reaching the upper stop and means for increasing the airfoil angle of attack responsive to the object reaching the lower stop.

21. The kit of claim 10, in which the elongate guide member is selected from the group consisting of a string, a cable, a ribbon, a wire, a tube and a rod.

22. A flying object assembly comprising:

an elongate guide member having a first end, a middle and a second end; wherein the first end is configured to be suspended from a stationary structure; and a flying object having a body having a front portion, a rear portion, a wing portion with a lifting surface, and a tubular and vertically oriented channel formed through the body, the channel being sized to slidably receive the elongate guide member; wherein the elongated guide member is under tension;

wherein, the vertical flying object can slide towards either the first or second ends of the elongate guide member when the vertical flying object is subjected to an air flow.

23. The flying object assembly of claim 22, further comprising a blower, wherein the blower is adapted to draw power from a power source.

24. The flying object assembly of claim 23, in which the blower is adapted to produce a variable output such that the body can ascend and descend along the elongate guide member responsive to the variable blower output.

25. A flying object assembly comprising:

an elongate member having first and second ends, wherein the first end is configured to be suspended from a stationary structure; and a flying object having a body having a front portion; a rear portion, a wing portion; and a tubular and vertically oriented channel formed through the body, the channel being sized to slidably receive the elongate guide member, wherein the wing portion enables the body to slide upward along the elongate guide member when subjected to air flow; the wing portion having an adjustable angle of attack in which the angle of attack is variable as between the body and the elongate guide member.

26. The flying object assembly claim 25, wherein the elongate guide member has strength in tension and essentially no strength in compression.

27. The flying object assembly of claim 25, further comprising a lower travel limiter and an upper travel limiter which restrict the amount of travel of the body along the elongate guide member.

28. The flying object assembly of claim 25, in which the channel can receive the elongate guide member in a first position in which the wing has a positive angle of attack providing lift, in a second position in which the wing has a more negative angle of attack than the first position, an in various positions in between the first and second positions.

29. The flying object assembly of claim 28, in which the channel includes an upper portion and a lower portion, in which the lower portion has a longer longitudinal extent than the upper portion, such that the angle of attack can be varied by varying the longitudinal position of the elongate guide member within the channel lower portion.

30. The flying object assembly of claim 28, in which the channel includes an upper portion and a lower portion, wherein the upper portion includes a slot and the lower portion includes an aperture, such that the angle of attack can be varied by varying the longitudinal position of the elongate guide member within the slot.

31. The flying object assembly of claim 25, further comprising a lock mechanism to lock the elongate guide member in position within the guide channel to impart a negative angle of attack to the flying object.

32. The flying object assembly of claim 31, in which the lock mechanism unlocks the angle of attack responsive to the flying object having downward travel along the elongate guide member.

33. The flying object assembly of claim 28, further comprising an elastic member coupled to the body and configured for bearing against the elongate guide member to provide spring action to store energy from downward angle of attack airfoil movement, and to urge the airfoil angle of attack further positive when the angle of attack does go towards negative.

34. The flying object assembly of claim 28, further comprising a spring configured and shaped to be disposed between the body and the elongate guide member which stores energy to urge the airfoil angle of attack further positive.

35. The flying object assembly of claim 28, further comprising an angle of attack selector coupled to the body which allows the angle of attack of the wing portion to be fixed in more than one angle.

* * * * *